US006519914B1

(12) United States Patent
Pesho

(10) Patent No.: US 6,519,914 B1
(45) Date of Patent: Feb. 18, 2003

(54) PERFORATION FORMING MODULE FOR A PACKAGING MACHINE

(75) Inventor: Stephen W. Pesho, Dalton, OH (US)

(73) Assignee: Euclid Spiral Paper Tube Corp., Apple Creek, OH (US)

( * ) Notice: Subject to any disclaimer, the term of this patent is extended or adjusted under 35 U.S.C. 154(b) by 0 days.

(21) Appl. No.: 09/904,262

(22) Filed: Jul. 12, 2001

(51) Int. Cl.[7] ..... B65B 61/14; B65B 9/00; B65B 9/02

(52) U.S. Cl. ..... 53/134.1; 53/553; 53/555; 53/450

(58) Field of Search ..... 53/413, 450, 134.1, 53/553, 554, 555, 900

(56) References Cited

U.S. PATENT DOCUMENTS

| | | | | |
|---|---|---|---|---|
| 3,878,746 A | | 4/1975 | Carmeli | |
| 3,938,298 A | * | 2/1976 | Luhman et al. | 53/555 |
| 4,481,700 A | | 11/1984 | Redmon | |
| 4,493,178 A | | 1/1985 | Buckner et al. | |
| 4,497,196 A | | 2/1985 | Bakermans et al. | |
| 4,821,556 A | | 4/1989 | Bakermans et al. | |
| 4,995,289 A | | 2/1991 | Bakermans | |
| 4,999,968 A | * | 3/1991 | Davis | 53/554 |
| 5,408,807 A | * | 4/1995 | Lane et al. | 53/554 |
| 5,826,471 A | | 10/1998 | Iguchi | |
| 5,887,722 A | * | 3/1999 | Albrecht et al. | 53/450 |
| 5,943,934 A | | 8/1999 | Codatto | |
| 6,115,997 A | * | 9/2000 | Burrow et al. | 53/553 |
| 6,195,966 B1 | * | 3/2001 | Shomron et al. | 53/553 |
| 6,209,286 B1 | * | 4/2001 | Perkins et al. | 53/553 |
| 6,212,853 B1 | * | 4/2001 | Yuyama et al. | 53/553 |

* cited by examiner

*Primary Examiner*—Anthony D. Stashick
(74) *Attorney, Agent, or Firm*—Renner, Kenner, Greive, Bobak, Taylor & Weber

(57) ABSTRACT

A perforation forming module for a packaging machine of the type converting strip material into a strip of interconnected packets, the module comprising first and second punch die assemblies disposed along a strip feed path and reciprocally moveable between a retracted position away from the feed path and closed mutual engagement on the feed path. The movement of the punch assemblies into their operative closed positions is synchronized with upstream clamping engagement between sealing jaws and the strip material so that the perforation operation occurs while the strip material is held in tension between upstream clamping jaws and downstream pull-down rollers.

18 Claims, 11 Drawing Sheets

PERFORATION FORMING MODULE FOR A PACKAGING MACHINE

TECHNICAL FIELD

The present invention relates generally to automated packaging machines for producing a ribbon of interconnected discrete packets, and more particularly to perforation forming modules for use in conjunction with such machines for the purpose of introducing a perforation through each packet within the ribbon.

BACKGROUND ART

Automated packaging machines that form a continuous ribbon of interconnected discrete packets or packages, each packet containing one or more articles such as pills or capsules, are well known. Such machines generally comprise a free standing frame; a first roll of flexible heat-sealable packaging material rotatably mounted on one end of the frame; a second coacting roll of a strip of flexible heat-sealable packaging material rotatably mounted on the other end of the frame opposite the first roll. The two strips of packaging material are guided from their respective rolls down through the frame in parallel, opposed formation. The heat-sealable portions of each strip are brought into opposed relationship.

The strips are advanced down through the frame by pull-down rolls in a predetermined sequence. Printed information such as a bar code or prescription identification is applied to one of the strips as the one strip advances through the frame. A turntable or disc is operatively mounted on the frame for feeding, in predetermined sequence, one or more pills or capsules between the two opposed strips of packaging material just as the strips are brought into contact by heat-sealing jaw members. The heat-sealing jaws are operatively disposed on the frame for heat sealing the margins on the two contacting strips of packaging material with the pill(s) entrapped therebetween. A hermetically sealed packet is thereby formed. A serration-forming knife blade is disposed on the heat sealing jaws for forming perforations on each transverse side of the packet. A cut-off blade is disposed at the bottom of the frame to severe the discrete packets from the ribbon as the ribbon advances below the pull-down rolls. A drive motor assembly is provided for activating the pull-down rolls, the turntable, the heat sealing jaws, and the cut-off blade.

A machine of the aforementioned type is taught and disclosed by U.S. Pat. No. 4,493,178, issued Jan. 15, 1985, and sold commercially by Euclid Spiral Paper Tube Corp., of Apple Creek, Ohio 44606 under the trade names CADET and CADET TWIN. The machines represent reliable means for automatically packaging pills or capsules into discrete packets for distribution to end patients and has met with enthusiastic acceptance in the medical treatment and pharmaceutical industries.

A recent development in the medical industry has been the creation of automated inventory systems that organize, select, and dispense packets, combinations of packets, to end patients. In such automated inventory systems, packets of medication, such as those created by the machine set forth in U.S. Pat. No. 4,493,178, are suspended from pegs along an inventory wall in an organized fashion. A computer controlled robotic machine is used to traverse the inventory wall and select appropriate packets by scanning the bar codes on each packet. The selected packets are mechanically removed from their respective peg and transported to a collection station, combined with other packets as necessary, and ultimately dispensed to end patients.

In order to facilitate suspension of the packets from pegs along such an inventory wall, it is required that each packet formed with perforation. The perforation must be appropriately sized and cleanly formed through the packet so as to allow the robotic picking machine to predictably attach and remove each packet from its associate wall peg. Moreover, the perforation through each packet must be formed in an efficient, preferably automated, manner that does not unduly add cost to the end package. Finally, the introduction of a perforation into each packet must be done in a manner that does not physically deform of the packet to an extent that would make the bar code or information printed on the packet illegible or compromise the integrity of the packet.

DISCLOSURE OF THE INVENTION

It is, therefore, an objective of the invention to provide a perforation forming module that efficiently and reliably introduces a perforation into a flexible manufactured packets.

A further objective is to provide a perforation forming module capable of automated use in conjunction with commercially available packaging machines.

Yet a further objective is to provide a perforation forming module for automated packet manufacturing machines capable of introducing a clean perforation into packets manufactured by such machines without detrimentally affecting the speed or efficiency of the manufacturing operation.

Another objective is to provide a perforation forming module for automated packet forming machines having high structural and functional reliability and requiring a relatively low level of maintenance.

Still a further objective is to provide a perforation forming module for automated flexible packet forming machines that efficiently, reliably, and automatically introduces a perforation into each packet manufactured by such machines without physically deforming or compromising the integrity of each flexible packet.

A further objective is to provide an efficient and reliable perforation forming module that is mechanically and functionally compatible with commercially available packet forming machines.

These, and other objectives that will be apparent to those skilled in the art, are achieved by an embodiment disclosed herein. The invention comprises a perforation module for packaging machines of the type that convert strip material into a ribbon of interconnected flexible packets. Commercially available packet forming machines comprise a strip feeder for feeding dual parallel strips of material along a feed path to a packet forming station located along the feed path above the strip feeder. Opposed heat sealing jaws within the packet forming station, on opposite sides of the feed path, meet intermittently along the feed path to form sealed flexible packets interconnected as a continuous ribbon.

The perforation module comprises first and second punch die assemblies disposed along the strip feed path between the strip feeder and the heat sealing jaws. The punch die assemblies are aligned with each other on opposite sides of the strip feed path and synchronously move in reciprocal fashion between retracted and closed positions to introduce a perforation into each packet leaving the packet forming station. The punch die assemblies are synchronized with the heat sealing jaws to meet along the strip feed path as the jaws are clamped against the strip material and the strip material is held in tension between the heat sealing jaws and the strip feeder.

The punch die assemblies comprise parallel guide rods that direct the die assemblies between the retracted and closed positions. One punch die assembly, in the preferred embodiment, is mounted to a common support block with one heat sealing jaw and moves unitarily therewith between the retracted and closed positions.

A further aspect of the invention is a method of performing a perforation operation in a packaging machine of the aforementioned commercial type. The method comprises the steps of interposing first and second punch die assemblies along the strip feed path between the strip feeder and the heat sealing jaws; aligning the punch die assemblies with each other on opposite sides of the strip feed path; moving the punch die assemblies into the feed path to perform a perforation forming operation; and synchronizing the movement of the punch die assemblies so that the perforation forming operation occurs while the sealing jaws are in clamping engagement with the strip material and the strip material is held in tension between the heat sealing jaws and the strip feeder.

THE DRAWING FIGURES

THE DISCLOSED EMBODIMENT

Figure 4:
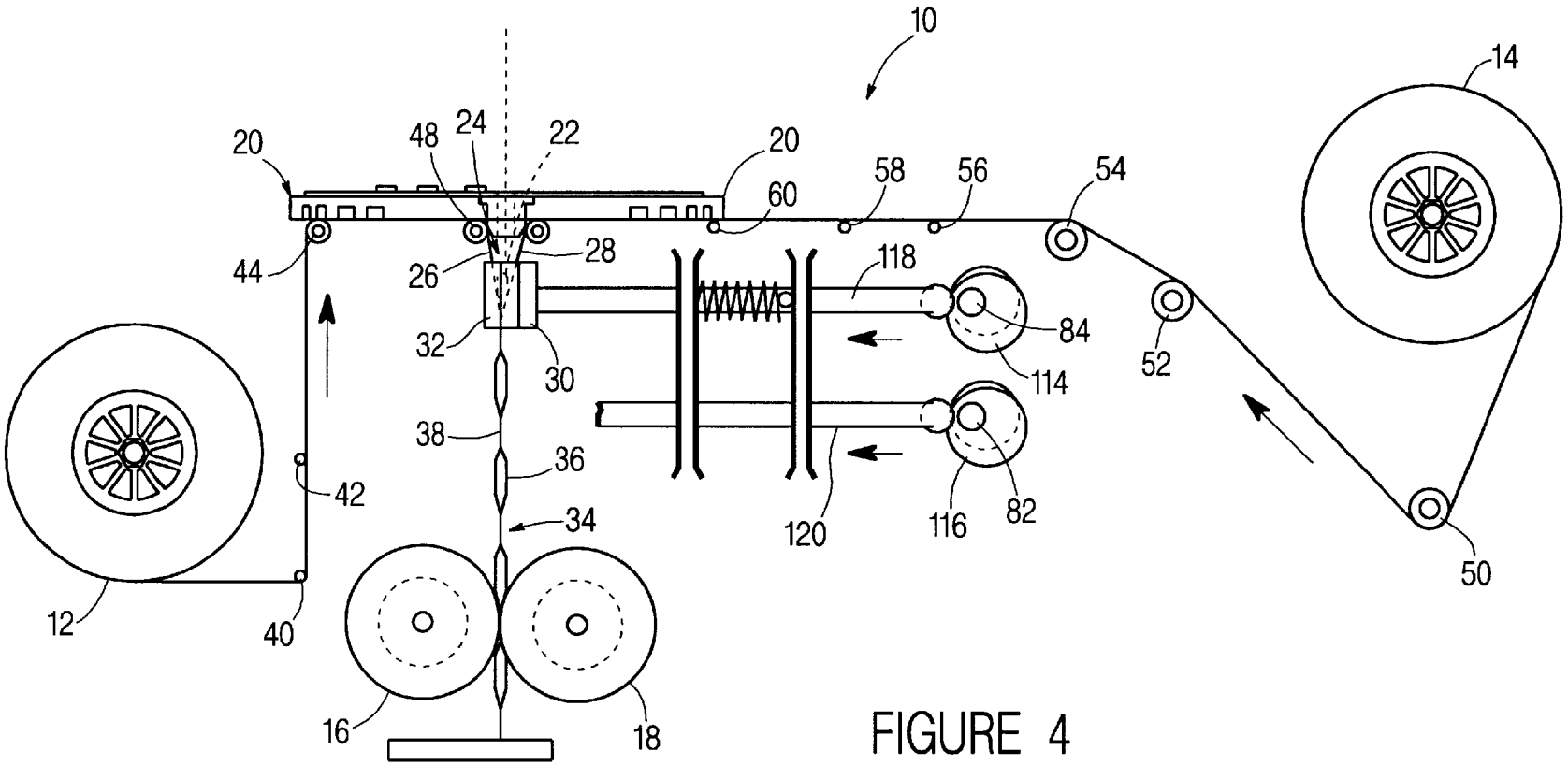
FIG. 4 is a diagrammatic view of the packaging machine, illustrating the process of forcing ribbon of packets.

FIG. 4 illustrates a packaging machine 10 in schematic form, of the commercial type in which the subject perforation module finds utility. The machine 10 is of a type taught by U.S. Pat. No. 4,821,556 incorporated herein by reference. A machine of the type shown is further commercially available, manufactured by Euclid Spiral Paper Tube Corp. at 339 Mill Street, Apple Creek, Ohio 44606 under the trade names THE CADET and CADET TWIN.

As shown in FIG. 4, the basic elements of the machine 10 comprise feed rolls 12, 14 of strip packaging material. Dual pull-down rolls 16, 18 are provided as illustrated. An indexing turntable or disc 20 is mounted in a horizontal plane at the top of the machine 10 and dispenses capsules or tablets 22 in a downward direction into a chute member 24. The feed roll 12 unreels a first strip material 26 and the feed roll 14 a second strip material 28. Material 26 is commercially available cellophane and material 28 comprises a foil and paper laminate. The paper side of the material 14 is printed with relevant information in a bar code and/or text format.

In operation, pills, tablets or capsules 22 to be package are initially placed in peripheral apertures in the disc 20 and, as the disc is selectively rotated, the pills drop down the chute 24 and thence in between the moving incoming strips of packaging material 26, 28 from the rolls 12, 14, respectively such strips 26, 28 being pulled down through the machine by the pull-down rolls 16, 18. After the tablet or pill 22 falls down between the opposed strips 26, 28, a heated sealing jaw 30 is moved against the heated sealing jaw back-up block 32 to heat-seal the tablet 22 between the strips 26, 28, thereby forming a continuous ribbon 34 of interconnected packets 36, the packets 36 being connected by alternative web sections 38. The progress of the strip material 26 to the top of the machine is guided by rollers, shown schematically in FIG. 4 as 40, 42, 44, 48. The progress of the strip material 28 to the top of the machine is guided by rollers, shown schematically as 50, 52, 54, 56, 58, and 60.

Figure 1:
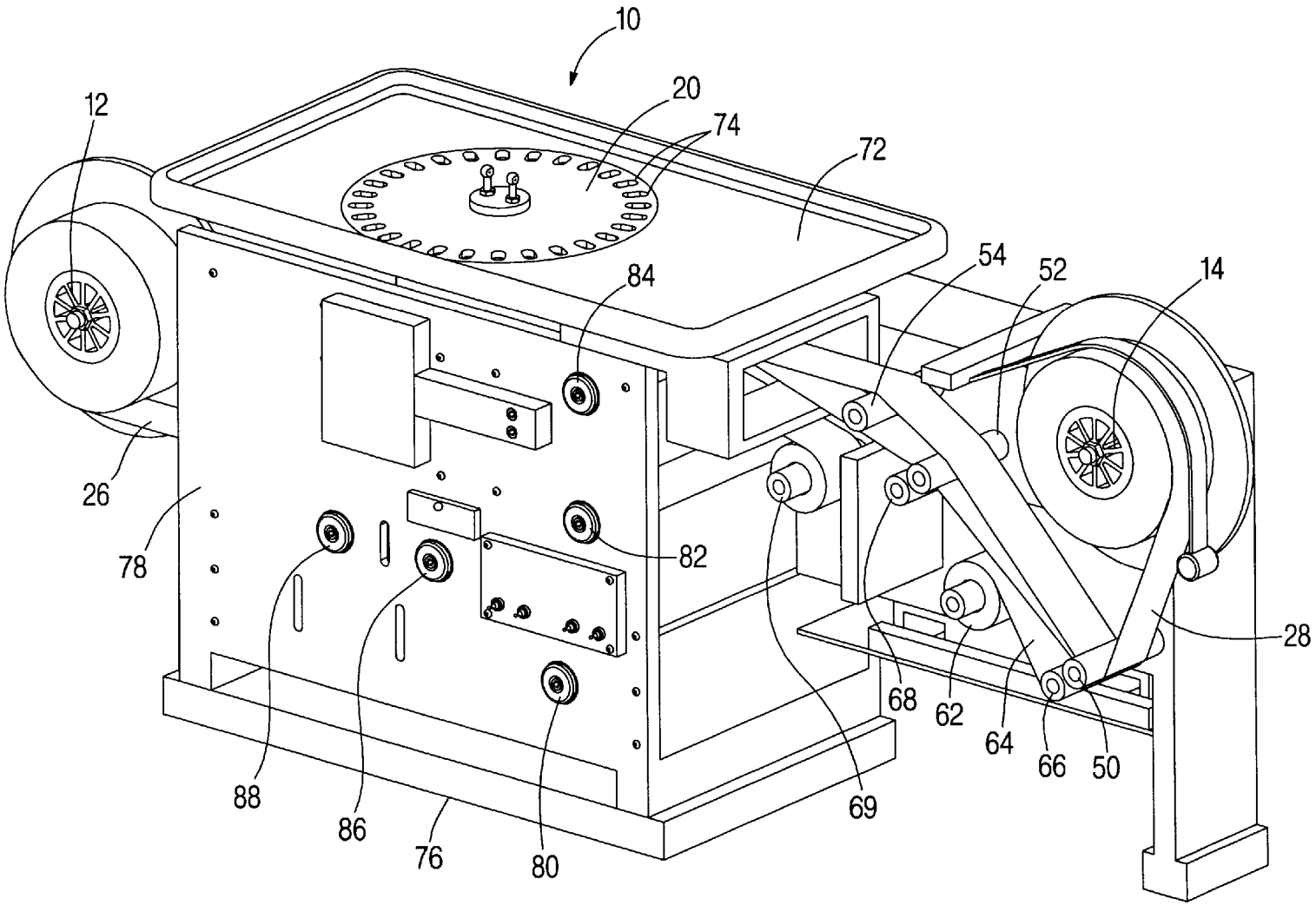
FIG. 1 is a right front perspective view of a packaging machine of the type in which the subject perforation module is incorporated.
Figure 3:
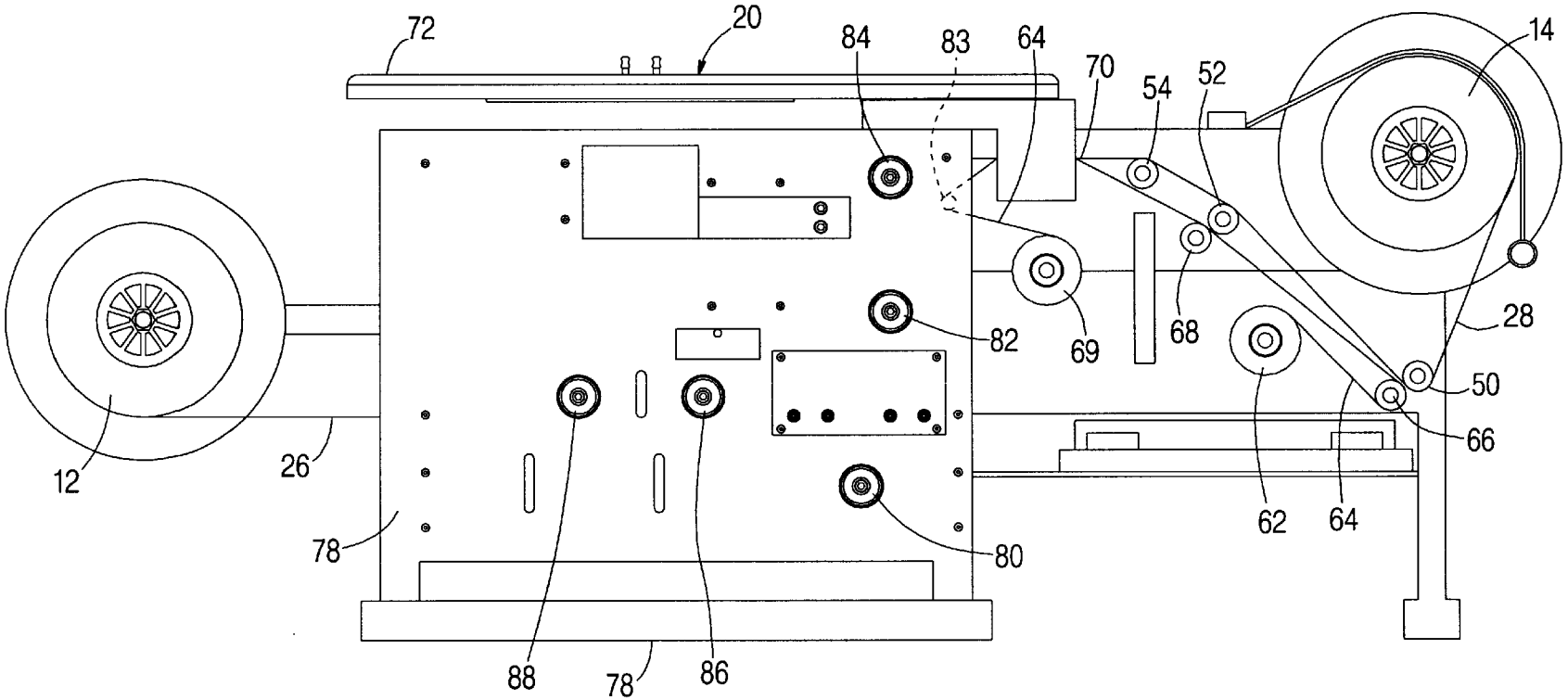
FIG. 3 is a front elevation view of a packaging machine of the type in which the subject perforation module is incorporated.
Figure 5:
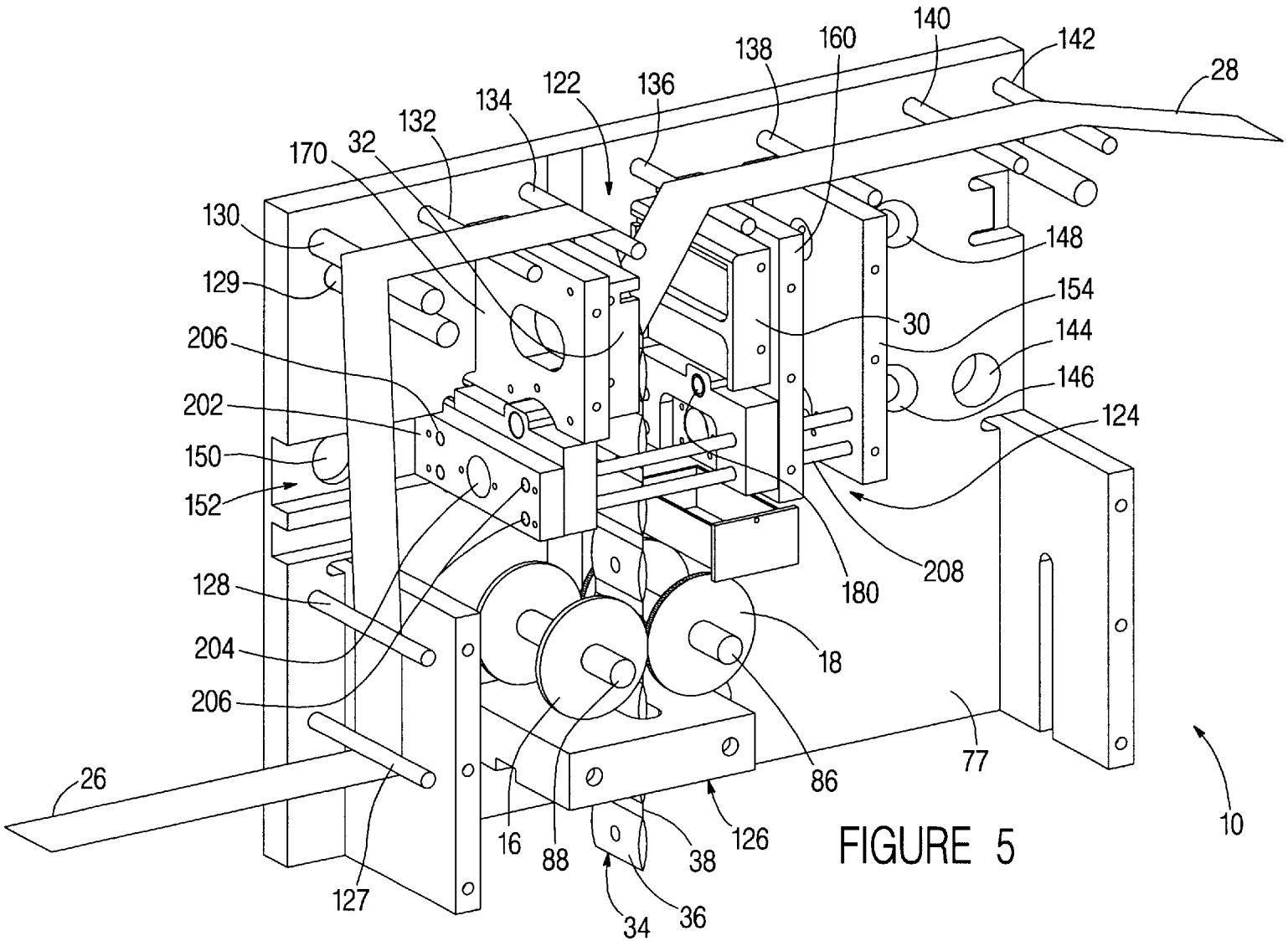
FIG. 5 is a left front perspective view of the internal configuration of the packaging machine illustration the packet forming, perforation, and cut-off stations.

As best shown in FIGS. 1, 3 and 5, the packaging machine 10 includes a print film supply roll 62 from which a strip of print film 64 is dispensed. The print film routes over rollers 66, 68, through printhead bracket assembly over roller 83, and to a take-up roller 69. The take-up roller 69 winds the print film for disposal. Foil strip 28 is dispensed from roll 14 around rollers 50, 52, 54 and converges with the print strip 64 at point 70, best seen from FIG. 3. A horizontal tray 72 is disposed at the top of the machine 10 and surrounds disc 20. The tray 72 is peripherally lipped to prevent capsules or pills from spilling to the floor. The disc 20 includes a series of dispensing compartments 74 about its periphery and functions to dispense tablets or capsules from the compartments 74 down through the machine 10 as taught in the '178 Patent.

The machine 10 generally comprises a base 76 and rearward and forward walls or panels 77, 78, respectively. The machine 10 is configured having a horizontally disposed cut-off blade cam shaft 80, punch cam shaft 82, main cam shaft 84, knurled pull-down roll shaft 86, and rubber pull-down roll shaft 88 oriented as shown in FIG. 3.

Figure 10:
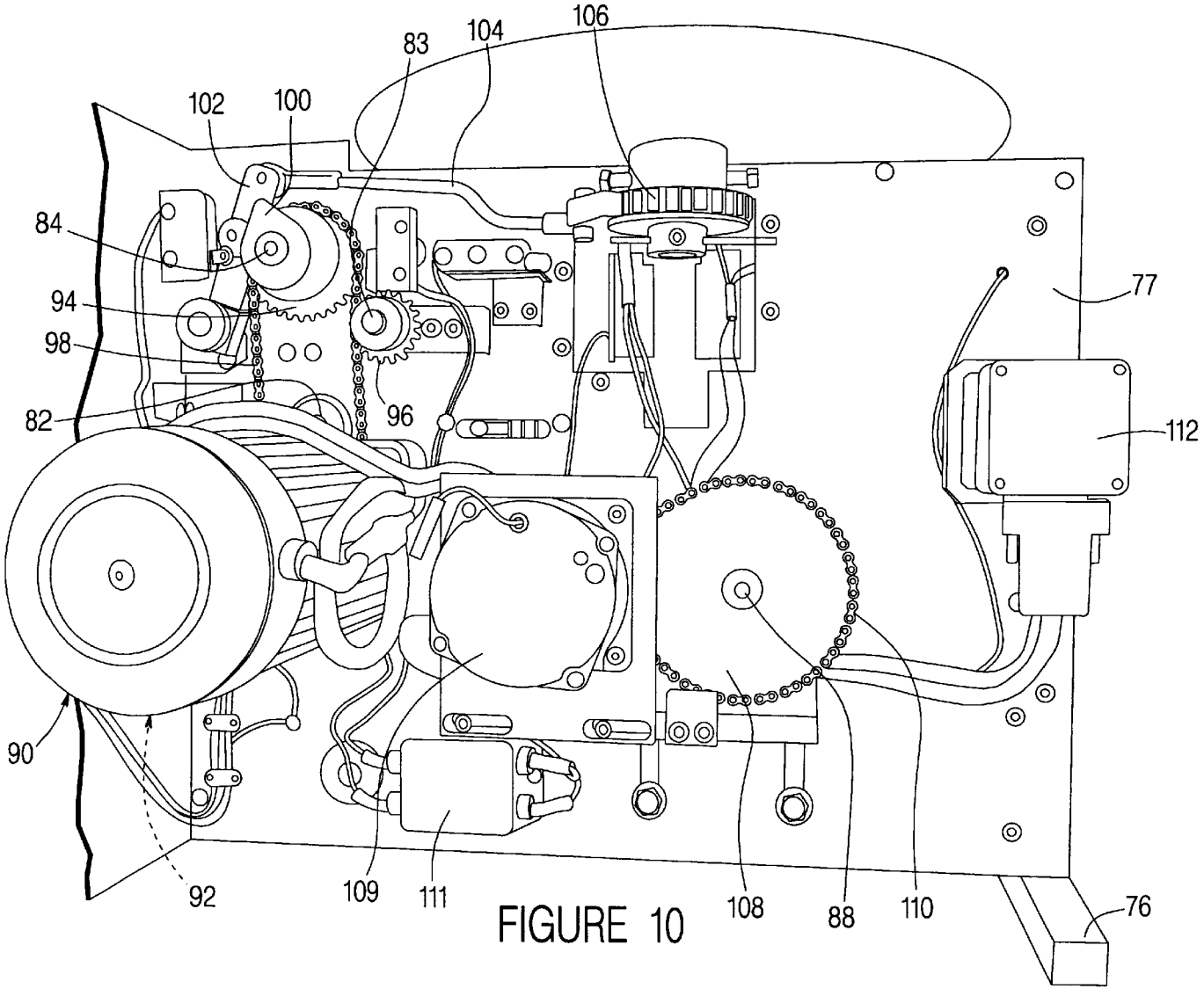
FIG. 10 is a partial rear perspective view of the packaging machine with the rear panel removed.

With reference to FIG. 10, the packaging machine includes an electric motor 90 and associated gearing. Connected to the motor 90 is an output shaft and sprocket wheel (not shown) that drives sprocket wheel 94. Disposed above the motor 90 is the main cam shaft 84 having the sprocket wheel 94 mounted thereon. The sprocket wheel 94 and the output sprocket wheel of motor 90 (not shown) are operatively connected by the sprocket chain 98. An idler shaft 83 has a sprocket 96 thereon which is also linked to the chain 98. With this structure, the motor 90 drives the shafts 82, 84.

The shaft 84 has a lever 102 that is rotatably connected to a cam 100 carried by shaft 84. The lever 102 is further connected to a lever arm 104 utilized to incrementally drive a disc sprocket 106. Rotation of shaft 84 causes cam 100 to engage lever 102 to rotate disc sprocket 106 by means of lever arm 104. A motor 109 is provided for the purpose of enabling an exact length package pull down. A plurality of commercially available motors are suitable. By way of example, a Superior Electric synchronous motor sold under the Model Type S5241-1023 and the tradename SLO-SYN motor will suffice. Situated below motor 109 is filter 111, utilized for 115 VAC line noise filtration. A suitably functional filter 111 is commercially available as a No. 10VWI Corcom EMI Filter. A secondary drive chain 110 is connected to a sprocket on the output shaft of motor 109 and to a drive sprocket 108 carried by pull-down roller shaft 88. Rotation of shaft 88 causes the machine to advance strip material by means of the pull-down rollers as will be explained below. A motor 112 is mounted as shown and connected by means of an output shaft to a punch assembly. The motor 112 is of a commercially type; by way of example, such a motor is sold under the tradename SMART-MOTOR as Model 2315 and 2337 by Animatics Corporation, located at 3050 Tasman Drive, Santa Clara, Calif. 95054.

FIG. 4 shows a cam 114 mounted to shaft 84. Cam 114 is connected to sealing jaw rod 118 that drives the sealing jaw 30 between a retracted and closed position. A cam 116 is mounted to shaft 82 and used to drive punch die rod 120 between a retracted and closed position. As will be appreciated from a combined consideration of FIGS. 4 and 10, shaft 82 is rotatably driven by the same drive chain 98 as shaft 84. Thus the shafts 82 and 84 are synchronized and drive their respective rods 118, 120 in synchronous fashion between the retracted and closed positions. The rods 118, 120 accordingly reciprocate unitarily between retracted and closed positions under the respective influence of drive shafts 84, 82.

Figure 6:
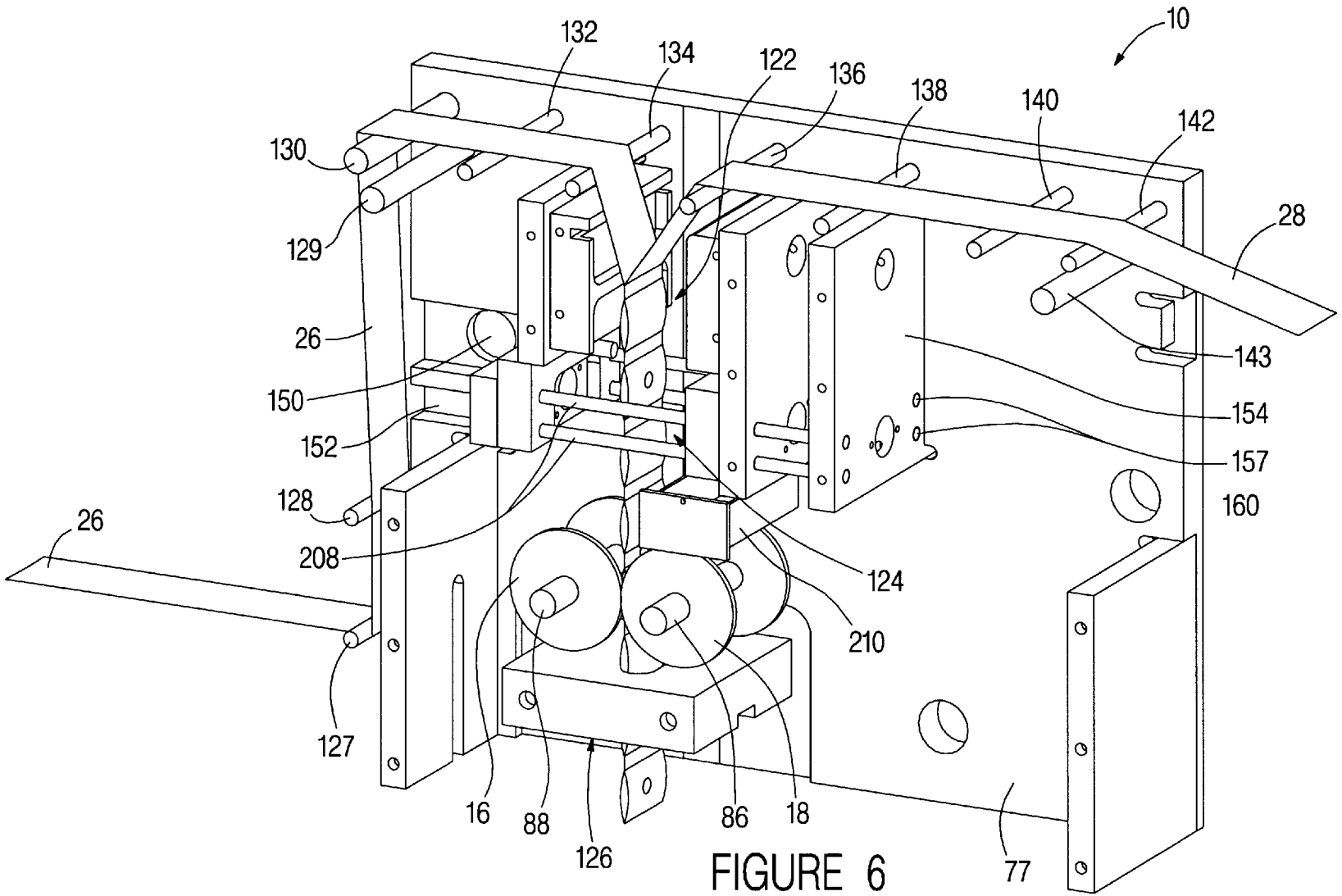
FIG. 6 is a right front perspective view thereof.

FIGS. 5 and 6 illustrate the internal operation of the packaging machine 10 fitted with the subject perforation module. The machine includes a packaging station, shown generally as 122; a punch or perforation-forming station 124; and a cutting station 126. It will be appreciated that the punch station 124 is situated adjacent to and below the packaging station 122, between the packaging station and the pull-down rollers 16, 18. The incoming strip material 26 is a cellophane and, as explained previously, the strip material 28 is a laminate of foil and paper. The strip 26 is routed along one side of the machine frame to the top center by means of rollers 127, 128, 129, 130, 132, and 134. The strip 28 is routed along an opposite side of the machine from to the top center by means of rollers 138, 140, and 142. Aperture 144 is provided through panel 77 and functions as a wire-through aperture. Aperture 148 extends through panel 77 and receives main drive shaft 84. Aperture 146 is disposed below aperture 148 and receives punch die drive shaft 82. On the opposite side of the frame, aperture 150 extends through the panel 77 and communicates with a horizontal channel 152 formed by inward facing surfaces of panels 77 and 78. The aperture 150 receives the punch die drive motor shaft therein as will be appreciated.

Figure 9:
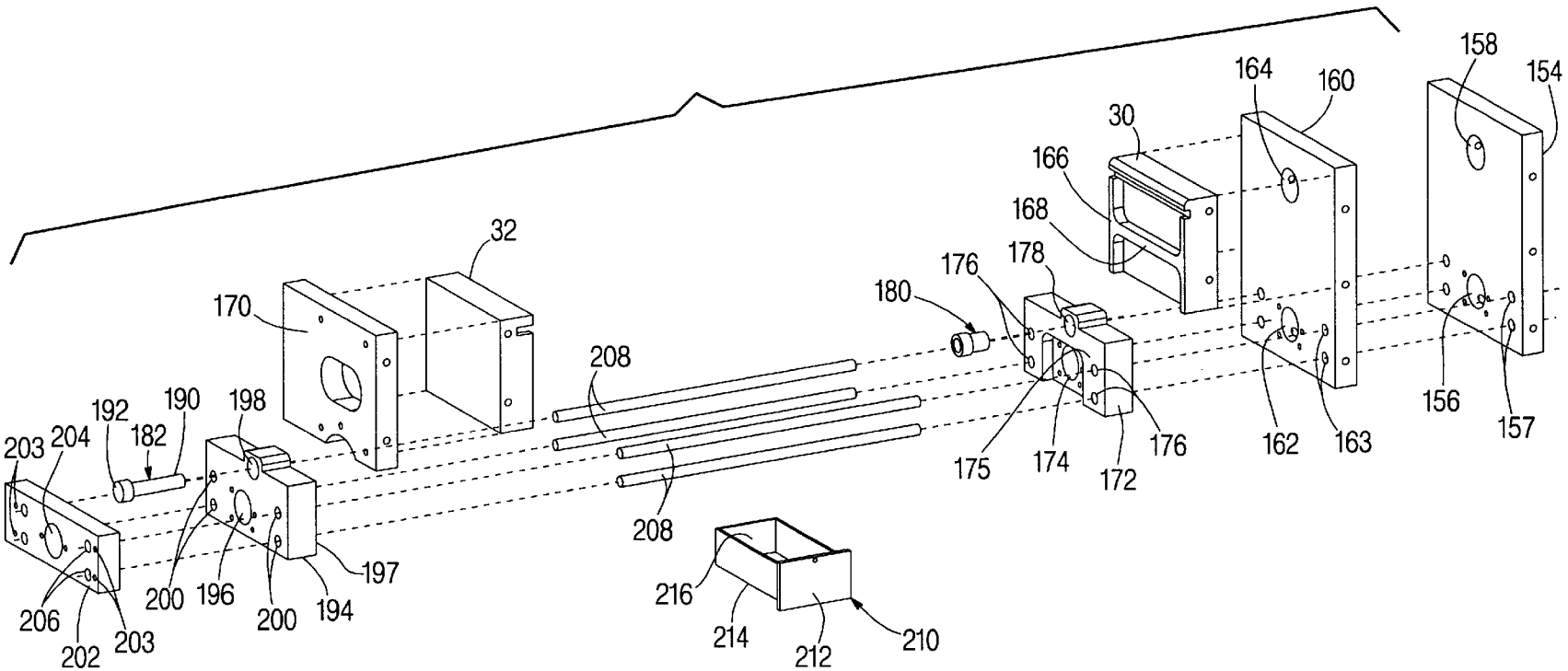
FIG. 9 is an exploded perspective view of the packet forming and perforation stations.

With reference to FIG. 9, the packaging and punch stations of the machine share a common rectangular back plate 154 , preferably of machined aluminum composition. The plate 154 includes a lower through bore 156; four guide rod seats 157 spaced as shown adjacent bore 156; and an upper through bore 158. Situated parallel with the plate 154 is a forward plate 160 of rectangular configuration, likewise preferably of machined aluminum composition. The forward plate 160 includes a lower through bore 162; four guide rod through bores 163 disposed as shown adjacent bore 162; and an upper through bore 164. Attached to rod 118 on a forward facing faceplate, by welding or other suitable attachment method, is the sealing jaw 30. Sealing jaw 30 is of steel composition and includes heating elements as taught in U.S. Pat. No. 4,493,178. The jaw 30 includes vertical spaced apart edge surfaces 166 and horizontal sealing surfaces 168.

The sealing jaw 30 is reciprocally moveable between a retracted position (right,ward as viewed in FIG. 9) and a closed position (leftward). The jaw 30 is disposed opposite a second, back sealing jaw 32 that is affixed in a stationary position adjacent the strip material feed path. Jaw 32 is configured in like manner to jaw 30 and includes heating elements within sealing surfaces. The jaw 32 is affixed to a back plate 170 as shown in FIG. 9 by welding or other suitable attachment method.

With continued reference to FIG. 9, the assembly further includes a female die block 172 of rectangular configuration formed of a suitable material such as machined aluminum but may be formed of other sufficiently hard substitute materials if so desired. The block 172 includes a central through bore 174; forwardly directed supporting surfaces 175; and four through bores 176 positioned as shown surrounding the bore 174. Extending through an upper portion of the block 172 is a female die seating bore 178. The bore 178 receives and retains a female die 180 therein.

Figure 8:
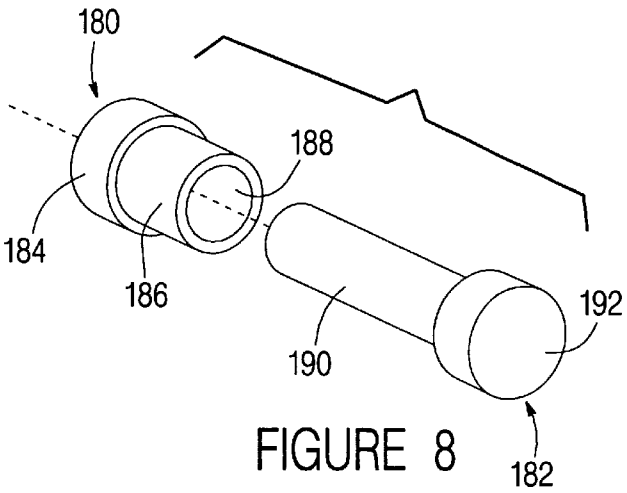
FIG. 8 is an exploded perspective view of the male and female die.

FIG. 8 shows the female die 180 and counterpart male die 182 in greater detail. The female die 180 is of tubular configuration having a rearwardly disposed annular collar portion 184 of relatively greater diameter and a forwardly disposed barrel portion 186 of smaller diameter. The female die 180 is seated within the bore 178 and collar portion 184 abuts an internal shoulder of the block 172 within bore 178. The male die member 182 includes a protruding cylindrical nose portion 190 and a rearwardly disposed circular end cap 192. The female and male die members 180, 182 are preferably formed of conventional metal such as machined steel but may be formed of other sufficiently hard substitute materials if so desired.

Referring to FIG. 9, opposite to the female die block 172 on the opposite side of the strip material feed path is a male die block 194 of rectangular general shape. The block 172 is formed preferably of machined aluminum but may be formed of other sufficiently hard substitute materials if so desired. The block 194 includes a through bore 196; a male die receiving bore 198 at a top end; and four through bores 200 surrounding the bore 196 as shown. The block 194 includes a forwardly facing clearing surface 197. It will be appreciated that the male die member 182 seats within the bore 198, with end cap 192 abutting an internal annular shoulder (not shown) within the bore and nose portion 190 protruding forwardly from the bore 198. The block 194 abuts a support block 202. The block 202 is of generally rectangular shape having four rod anchoring bores 206 and four mounting holes 203 proximate respective corners and a central through bore 204.

Four elongate steel guide rods 208 are included in the assembly. In addition, a chad drawer 210 is provided of generally rectangular configuration having a frontal face panel 212 and a rectangular container 214 defining a top opening central chamber 216. The drawer 210 may be formed of any suitable material such as metal or plastic.

The assembly of FIG. 9 is shown assembled by FIGS. 5 and 6. With combined reference to FIGS. 5, 6, and 9, the plates 154, 160 are mounted to the machine frame in a spaced apart, parallel vertical orientation on one side of the strip feed path. A right end of the guide rods 208 project through the four bores 176 of die block 172, the four bores 163 of plate 160, and are anchored within the apertures 157 of plate 154. The left end of the guide rods 208 project through the four corner bores 200 of die block 194 and are anchored within bores 206 of back plate 202. The support plate 154 and back plate 202 are fixedly held within the machine frame while the die blocks 172, 194 are free to reciprocally slide along guide rods 208 between outward ends of rods 208 (the "retracted" position as used herein) and a central position on rods 208 (the "closed" position) in which the surfaces 175, 197 of die blocks 172, 194 are in close opposition.

As best seen from FIGS. 4, 5, 6, 9, and 10, the back plate 170 and back up jaw 32 are fixedly positioned to a left side of a strip feed path down along a transverse center axis of the machine 10. The opposite sealing jaw 30 abuts against fixed plate 160. The drive cam shaft 84 projects through aperture 148 and activates drive rod 118 to reciprocally move the sealing jaw 30 between a rightward, retracted position, and a leftward, closed position in which jaw 30 clamps against back up jaw 32. As taught, by U.S. Pat. No. 4,493,178, when in the closed position, the sealing jaws 30, 32 cooperatively act to seal strip fed material 26, 28 into discrete, packets 36 filled from disc 20 with tablets or capsules. The jaw 30 intermittently moves between the retracted and closed positions while jaw 32 remains fixed as the strip material 26, 28 is drawn down along the feed path by rollers 16, 18.

As a result, a ribbon 34 of discrete packets 36 interconnected by connective web segments 38 is created. The ribbon 34 of packets advances downward past the rollers 16, 18 to a cutting station 126 where a horizontally disposed reciprocal blade acts to separate the packets 36 from the ribbon and discharges the loose packets from a bottom of the machine.

The introduction of a perforation into each packet for the purpose of allowing the packet to be inventoried on a peg or hook, is accomplished at the punch station 124. Punch station 124 comprises the opposed male and female punch dies 180, 182 disposed on opposite sides of the strip material feed path. Female punch die 180 mounts within bore 178 of holder 172 and is carried thereby in reciprocal fashion along rods 208 between the retracted and closed positions. The cam shaft 82 projects through aperture 146 of panel 77 and is attached to a rearward end of rod 120. The forward end of rod 120 projects through plate bores 156, 162, and is anchored within block bore 174. Rod 120 thereby serves to actuate reciprocal movement of the female die block 172 in response to rotation of cam shaft 82.

It will be appreciated that shaft 82 is coupled to and follows the main cam shaft 84 that drives sealing jaw 30 between the closed and retracted positions. Thus, shaft 82 synchronously moves the female die block 172 between the retracted and closed positions by rod 120 as the sealing jaw 30 is moved between the retracted and closed positions by rod 118. Both the sealing jaw 30 and the female die block synchronously move into the closed and retracted positions during the operation of the machine.

Figure 11:
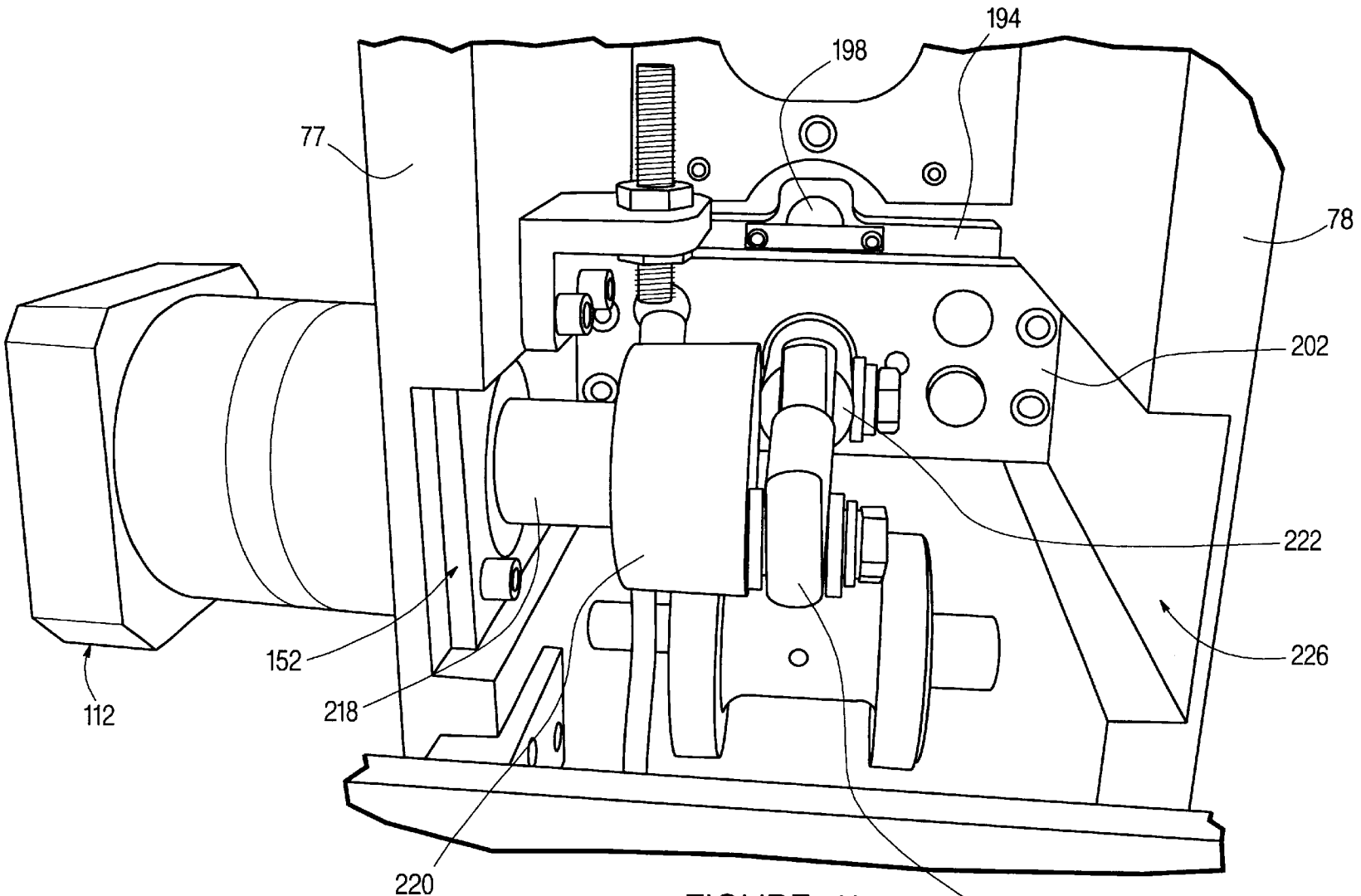
FIG. 11 is a left side perspective view of the motor drive assembly of the male punch die.
Figure 12:
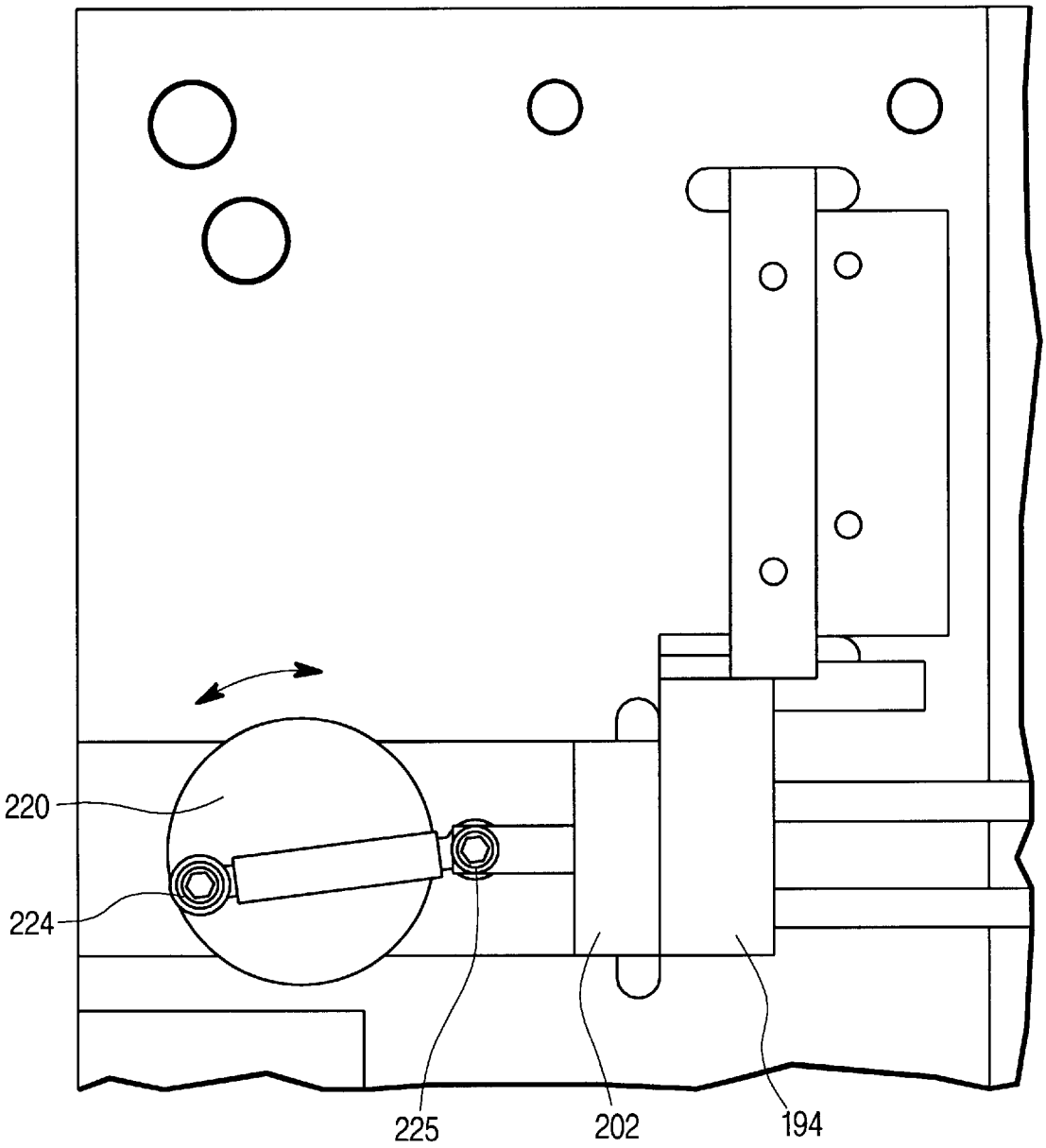
FIG. 12 is a front elevational view of the motor drive assembly of the male punch die.

The male die member 190 is mounted within bore 198 of the die block 194 and slides therewith along rods 208 between the retracted, outward position and the closed, inward position. As will be seen from FIGS. 11 and 12, the motor 112 includes an output cam shaft 218 to which a cam 220 is mounted. Connected at one end 224 to cam 220 is a drive rod 222. A pivot joint 225 is located forward from the end 224 and a forward end of drive rod 222 extends through the bore 204 of back plate 202 and seats within bore 196 of male die block 194. The rod 222 moves reciprocally right and left as the shaft 218 rotates to drive the die block 194 along guide rods 208 between the closed and retracted positions. Movement of male die block 194 is synchronized with movement of female die block 172 so that the male and female die blocks meet simultaneously at the strip feed path in respective closed positions. As discussed previously, the sealing jaw 30 is likewise synchronized to move into its closed position in clamping engagement with the back up jaw 32 at the same time as the die blocks 194, 172 meet at the strip feed path.

The female and male die members 180, 182 meet at the strip feed path and couple to perforate each packet 36 as the packet progresses from the packing station 122 downward the pull-down rollers 16, 18. The punching operation is timed to occur when the sealing jaw 30 is in clamped engagement with the back up jaw 32, performing the packet forming operation at station 122. The strip material lines 26, 28 are intermittently clamped by the jaws 30, 32 in the packing station 122 so as to form packets 36. When in the closed position, the jaws 30, 32 and the pull-down rollers 16, 18 operatively hold the ribbon 34 in tension there between. While the ribbon is thusly held in tension, the punch die 180, 182 effectuate a perforation through a packet position within the punch station 124. The male and female die blocks jointly move inward to meet along the strip feed path where the male and female die engage.

Figure 2:
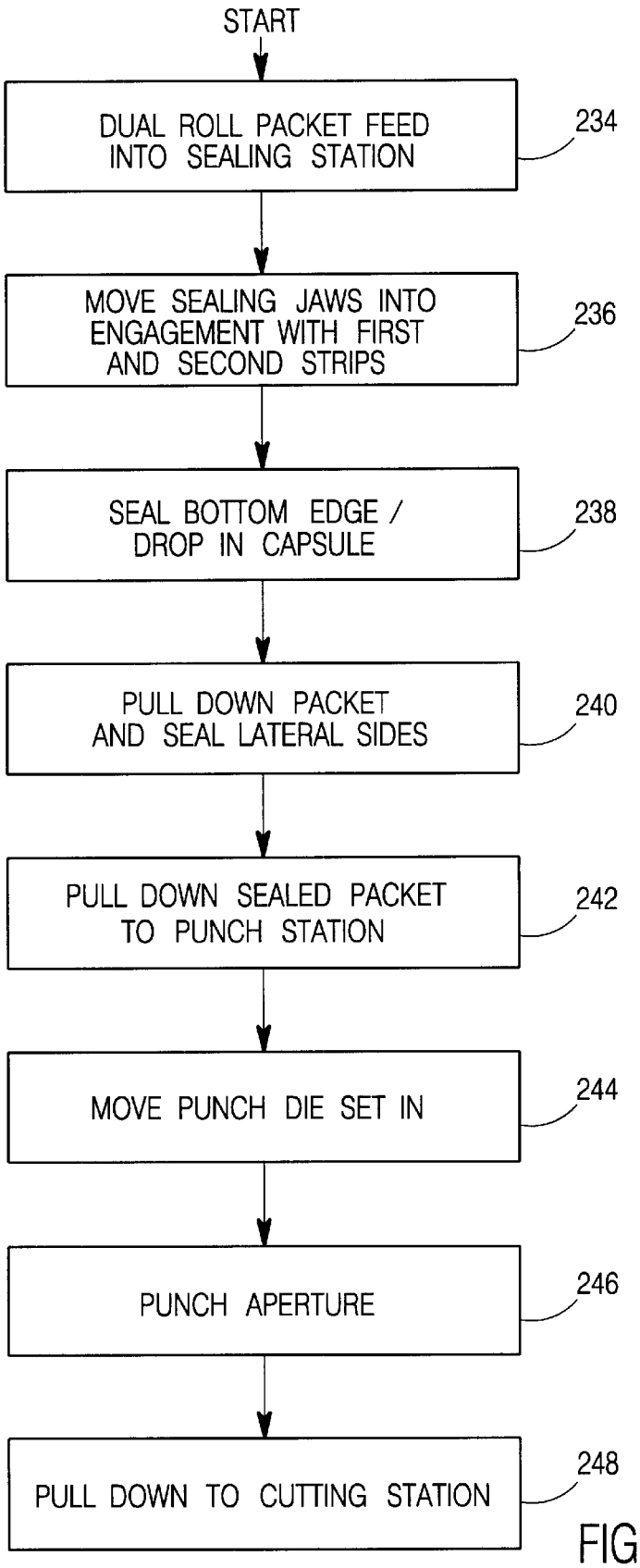
FIG. 2 is a flow chart of the process in which a packet is formed and perforated by the machine of FIG. 1.
Figure 7:
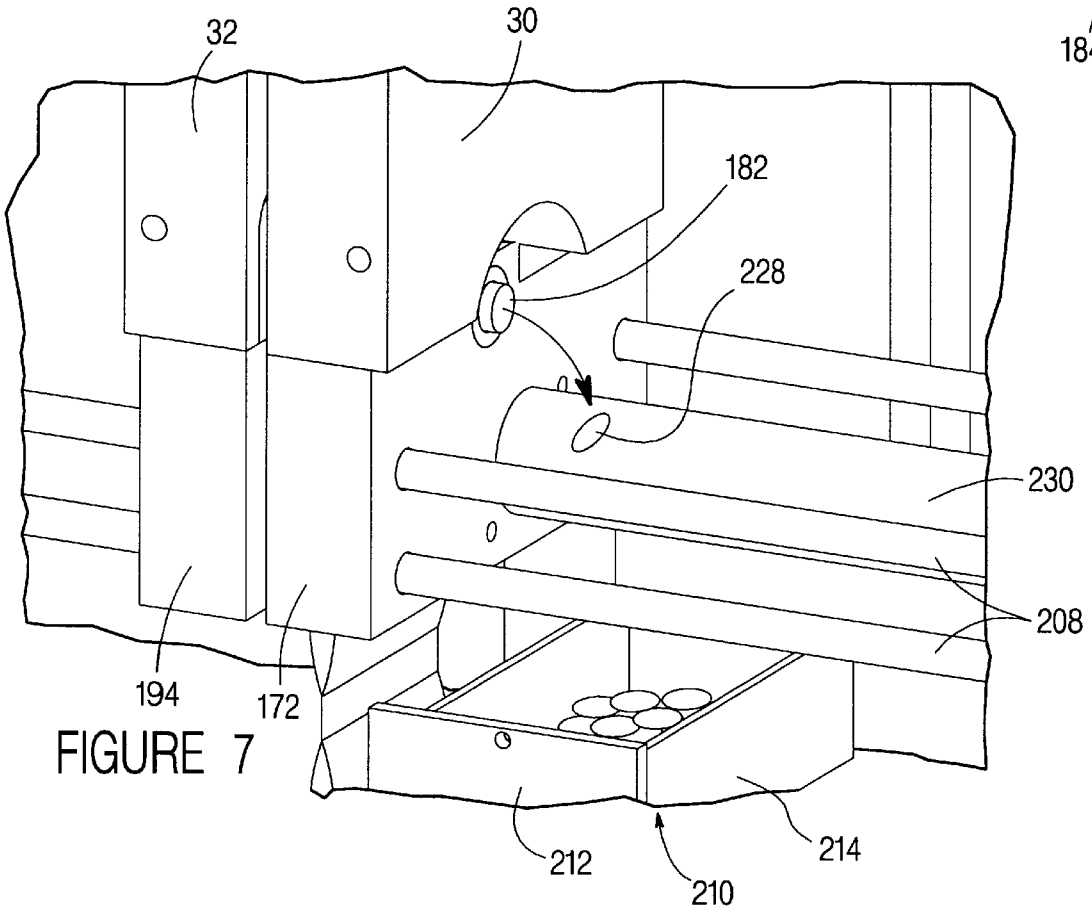
FIG. 7 is an enlarged perspective view of the perforation station in the closed position.

FIG. 7 illustrates that the punch operation between die blocks 194, 172 occurs while the jaws 30, 32 are in the closed position. Chads 228 from the punch operation are discharged into the drawer 210 and may be removed and emptied when full. The operative steps performed on each packet by the machine 10 are summarized in FIG. 2. As shown, the dual rolls of strip material 26, 28 are routed to the top of the machine into the sealing or packing station 122 (step 234). Thereafter, the jaws 30, 32 meet to form a filled packet (steps 236, 238, 240). The packet leaves the packing station 122 and is pulled down into the punch station 124 (step 242). The punch die move in (step 244) and effect a perforation of the packet (step 246) as a trailing packet is being formed in the packing station 122. Finally, the packet is pulled into the cutting station 126 and severed from the ribbon 34.

The punch assembly as described above is reliable provides high structural reliability. The perforation formed thereby is cleanly formed as the two punch die are jointly brought into engagement at the strip feed path. Moving only one die into a packet in order to effect a perforation would tend to push the target packet away, causing a deformation in the packet geometry. Since the packets are formed of flexible material, such a deformation tends to be permanent. Packets so deformed not only are visually unattractive, but such a deformation can make the information carried on the packets, such as a bar code, illegible. The subject invention avoids deformation of each packet during the perforation forming step by bringing the male and female die into clamping engagement about the packet simultaneously. The packet accordingly cannot deflect and is held, firmly while the perforation is made.

Moreover, the quality of the perforation is enhanced by the synchronous manner in which the punch die and the sealing jaws operate. As explained previously, the punch operation occurs while the sealing jaws are clamped together forming a packet. The ribbon is consequently held in tension between the sealing jaws and the pull down rollers. A taut ribbon further minimizes deflection of a packet in the punch station and allows the male and female die to effect a clean perforation with a minimal level of packet distortion.

From the foregoing, it will be appreciated that the perforation forming module of the subject invention can be incorporated into commercially available packet forming machines such as that taught in U.S. Pat. No. 4,493,178. The operation of the perforation forming station is independent of the operation of the other, conventional, stations in the machine. Thus, incorporation of the subject module into the assembly of conventional packaging machines may be accomplished with minimal cost and inconvenience. Importantly, providing a perforation forming module that is mechanically and functionally compatible with commercially available packet forming machines and that does not require modification of components associated with the other operations performed by such machines, makes industry acceptance and use of the subject perforation forming module more likely.

The subject perforation forming module additionally provides a high structural and functional reliability and requires a relatively low level of maintenance. The four guide rods 208 securely and soundly support the reciprocal movement of the die blocks and assure that the perforation forming module will function as intended through a high number of cycles.

Representative motor and drive mechanisms used to operatively advance the strip material through the machine and actuate the sealing jaws, punch die, and associative mechanisms are set forth herein and in U.S. Pat. No. 4,493,178, incorporated herein by reference. However, the subject invention may be used with other drive configurations apparent to those skilled in the art without departing from the teachings of the invention. Other conventional drive mechanisms may be substituted to advance strip material through a packet forming station and through a perforation station of the type comprising the subject invention, if so desired. Moreover, the embodiment of the perforation module set forth herein, while preferred, is merely representative. Other embodiments, which will be apparent to those skilled in the art and which utilize the teachings herein set forth, are intended to be within the scope and spirit of the subject invention.

What is claimed is:

1. A perforation module for performing perforation operations in a packaging machine that converts strip material into a strip of interconnected discrete packages, the machine comprising a strip feeder for feeding the material along a strip feed path, a packaging zone on the strip feed path for intermittently combining the material to form the strip of interconnected discrete packages, first and second jaws in the packaging zone, the jaws being aligned with each other on opposite sides of the strip feed path and at least one jaw movable toward and away from the strip feed path between a retracted position, in which the one jaw is spaced from the feed path and a closed position in which the one jaw is substantially clamped against the strip material on the strip feed path, the perforation module comprising: first and second punch die assemblies in a punch zone disposed along the strip feed path between the strip feeder and the packaging zone, the punch die assemblies being aligned with each other on opposite sides of the strip feed path and at least one punch die assembly movable towards and away from the strip feed path along a path of reciprocation between a retracted position, in which the one punch die assembly is spaced from the feed path, and a closed position, in which the one punch die assembly performs a perforation operation on a package exiting the packaging zone on the strip feed path, the one punch die assembly operating synchronously with the one jaw in the packaging zone so that the perforation operation occurs while the one jaw is clamped against the strip material and the strip material is held in tension between the one jaw and the strip feeder; and a tooling assembly for moving the one punch die assembly between the retracted and closed positions, the tooling assembly including at least one guide rod disposed parallel to the one punch die path of reciprocation; a support block disposed on the path of reciprocation and carrying the one punch die assembly, the support block being coupled to slide along the guide rod and carry the one punch die assembly between the retracted and closed positions.

2. A perforation module as set forth in claim 1, wherein the punch die assemblies comprise male and female die members.

3. A perforation module as set forth in claim 1, wherein the one punch die assembly moves unitarily with the one jaw.

4. A perforation module as set forth in claim 3, wherein the one punch die assembly and the one jaw are mounted to the support block.

5. A perforation module for performing perforation operations in a packaging machine that converts strip material into a strip of interconnected discrete packages, the machine comprising a strip feeder for feeding the material along a strip feed path, a packaging zone on the strip feed path for intermittently combining the material to form the strip of interconnected discrete packages, first and second jaws in the packaging zone, the jaws being aligned with each other on opposite sides of the strip feed path and at least one jaw movable toward and away from the strip feed path between a retracted position, in which the one jaw is spaced from the feed path and a closed position in which the one jaw is substantially clamped against the strip material on the strip feed path, the perforation module comprising: first and second punch die assemblies in a punch zone disposed along the strip feed path between the strip feeder and the packaging zone, the punch die assemblies being aligned with each other on opposite sides of the strip feed path and at least one punch die assembly movable towards and away from the strip feed path along a path of reciprocation between a retracted position, in which the one punch die assembly is spaced from the feed path, and a closed position, in which the one punch die assembly performs a perforation operation on a package exiting the packaging zone on the strip feed path, the one punch die assembly operating synchronously with the one jaw in the packaging zone so that the perforation operation occurs while the one jaw is clamped against the strip material and the strip material is held in tension between the one jaw and the strip feeder, the second punch die assembly moving synchronously with the one punch die assembly towards and away from the strip feed path along a path of reciprocation between a retracted position, in which the second punch die assembly is spaced from the feed path, and a closed position, in which the second punch die assembly performs a perforation operation with the one punch die assembly on a package exiting the packaging zone on the strip feed path.

6. A perforation module as set forth in claim 5, wherein the one punch die assembly and the second punch die assembly comprise mating male and female die members.

7. A perforation module as set forth in claim 6, wherein the male and female die members mate as the one jaw is clamped against the strip material and the strip material is held in tension between the one jaw and the strip feeder.

8. A perforation module as set forth in claim 5, wherein further comprising a tooling assembly for moving the one punch die assembly and the second punch die assembly between respecitive retracted and closed positions, the tooling assembly comprising:

at least one guide rod disposed parallel to the respective paths of reciprocation of the one punch die assembly and the second punch die assembly;

a first support block carrying the one punch die assembly along the one punch die path of reciprocation, the support block being coupled to slide along the guide rod and carry the one punch die assembly between its retracted and closed positions; a second support block carrying the second punch die assembly along the second punch die path of reciprocation, the support block being coupled to slide along the guide rod and carry the second punch die assembly between its retracted and closed positions.

9. A perforation module as set forth in claim 8, wherein the tooling assembly further comprising a drive motor for moving the second support block along the second punch die path of reciprocation, the drive motor being capable of selective deactivation to disable the perforation operation at the option of a user of the packaging machine.

10. A perforation module as set forth in claim 9, wherein the one punch die assembly moves unitarily with the one jaw.

11. A perforation module as set forth in claim 10, wherein the one punch die assembly and the one jaw are mounted to the first support block.

12. A packaging machine for converting strip material into a strip of interconnected discrete packages, the machine comprising: a strip feeder for feeding the material along a strip feed path; a packaging zone on the strip feed path for intermittently combining the material to form the strip of interconnected discrete packages; first and second jaws disposed in the packaging zone, the jaws being aligned with each other on opposite sides of the strip feed path and at least one jaw movable towards and away from the strip feed path between a retracted position, in which the one jaw is spaced from the feed path and a closed position in which the one jaw is substantially clamped against the strip material on the strip feed path; a perforation module disposed in a punch zone adjacent the packaging zone and comprising first and second punch die assemblies aligned with each other on opposite sides of the strip feed path and at least one punch die assembly movable towards and away from the strip feed path along a path of reciprocation between a retracted position, in which the one punch die assembly is spaced from the feed path, and a closed position, in which the one punch die assembly performs a perforation operation on a package exiting the packaging zone on the strip feed path, the one punch die assembly operating synchronously with the one jaw in the packaging zone so that the perforation operation occurs while the one jaw is clamped against the strip material and the strip material is held in tension between the one jaw and the strip feeder, and a tooling assembly for moving the one punch die assembly between the retracted and closed positions, the tooling assembly including at least one guide rod disposed parallel to the one punch die path of reciprocation; a support block disposed on the path of reciprocation and carrying the one punch die assembly, the support block being coupled to slide along the guide rod and carry the one punch die assembly between the retracted and closed positions.

13. A packaging machine as set forth in claim 12, wherein the punch die assemblies comprise male and female die members.

14. A packaging machine as set forth in claim 12, wherein the one punch die assembly moves unitarily with the one jaw.

15. A packaging machine as set forth in claim 14, wherein the one punch die assembly and the one jaw are mounted to the support block.

16. A packaging machine for converting strip material into a strip of interconnected discrete packages, the machine comprising: a strip feeder for feeding the material along a strip feed path; a packaging zone on the strip feed path for intermittently combining the material to form the strip of interconnected discrete packages; first and second jaws disposed in the packaging zone, the jaws being aligned with each other on opposite sides of the strip feed path and at least one jaw movable towards and away from the strip feed path between a retracted position, in which the one jaw is spaced from the feed path and a closed position in which the one jaw is substantially clamped against the strip material on the strip feed path; a perforation module disposed in a punch zone adjacent the packaging zone and comprising first and second punch die assemblies aligned with each other on opposite sides of the strip feed path and at least one punch die assembly movable towards and away from the strip feed path along a path of reciprocation between a retracted position, in which the one punch die assembly is spaced from the feed path, and a closed position, in which the one punch die assembly performs a perforation operation on a package exiting the packaging zone on the strip feed path, the one punch die assembly operating synchronously with the one jaw in the packaging zone so that the perforation operation occurs while the one jaw is clamped against the strip material and the strip material is held in tension between the one jaw and the strip feeder, the second punch die assembly moving synchronously with the one punch die assembly towards and away from the strip feed path along a path of reciprocation between a retracted position, in which the second punch die assembly is spaced from the feed path, and a closed position, in which the second punch die assembly performs a perforation operation with the one punch die assembly on a package exiting the packaging zone on the strip feed path.

17. A packaging machine as set forth in claim 16, wherein the one punch die assembly and the second punch die assembly comprise mating male and female die members.

18. A packaging machine as set forth in claim 17, wherein the male and female die members mate as the one jaw is clamped against the strip material and the strip material is held in tension between the one jaw and the strip feeder.

* * * * *